United States Patent [19]

Iwamoto et al.

[11] Patent Number: 5,022,457

[45] Date of Patent: Jun. 11, 1991

[54] CASTING CONTROL SYSTEM OF DIE CAST MACHINE

[75] Inventors: Norihiro Iwamoto; Hiroyuki Tsuboi; Toshihiko Kaneko, all of Zama, Japan

[73] Assignee: Toshiba Machine Co., Ltd., Tokyo, Japan

[21] Appl. No.: 303,236

[22] Filed: Jan. 30, 1989

[30] Foreign Application Priority Data

Jan. 30, 1988 [JP] Japan ..... 63-19998
Jun. 27, 1988 [JP] Japan ..... 63-158285

[51] Int. Cl.[5] ..... B22D 17/00

[52] U.S. Cl. ..... 164/155; 164/157; 164/305; 164/312; 164/457

[58] Field of Search ..... 164/41, 154, 155, 157, 164/305, 312, 457

[56] References Cited

U.S. PATENT DOCUMENTS

| | | | |
|---|---|---|---|
| 3,767,339 | 10/1973 | Hunkar | 164/154 |
| 4,463,793 | 8/1984 | Thurner | 164/154 |
| 4,493,362 | 1/1985 | Moore et al. | 164/155 |
| 4,530,391 | 7/1985 | Fink et al. | 164/312 |
| 4,559,991 | 12/1985 | Motomura et al. | 164/155 |
| 4,610,831 | 9/1986 | Mihara | 164/457 |
| 4,836,272 | 6/1989 | Priem | 164/305 |
| 4,852,634 | 8/1989 | Kawai et al. | 164/154 |

FOREIGN PATENT DOCUMENTS

| | | | |
|---|---|---|---|
| 126174 | 11/1984 | European Pat. Off. | 164/457 |
| 131061 | 10/1981 | Japan | 164/155 |
| 92060 | 5/1985 | Japan | 164/155 |
| 31587 | 7/1985 | Japan | 164/155 |
| 2292251 | 12/1987 | Japan | 164/155 |
| 303672 | 12/1988 | Japan | 164/154 |

*Primary Examiner*—Richard K. Seidel
*Assistant Examiner*—Edward A. Brown
*Attorney, Agent, or Firm*—Cushman, Darby & Cushman

[57] ABSTRACT

This invention relates to a casting control system of a die cast machine, and more particularly to a system for controlling a high speed injection real stroke of an injection plunger and controlling valve closing timing for degassing gas in a mold cavity. The high speed injection real stroke is measured by an arithmetic unit from a signal output from a position detector, and the high speed injection real stroke is then compared with a certain preset value. When arithmetic unit determines that the high speed injection real stroke and the preset value do not coincide with each other, a pretest action delay time of the injection plunger is ± incrementally or decrementally corrected until both values coincide. The arithmetic unit determines a start position of the high speed injection real stroke, outputs a signal to close a breathing valve at a position, to which is added or from which is subtracted a predetermined variable value with respect to the real start position and outputs a signal to open the breathing valve at a position where the injection plunger closes a molten metal feeding port.

9 Claims, 9 Drawing Sheets

CASTING CONTROL SYSTEM OF DIE CAST MACHINE

BACKGROUND OF THE INVENTION

1. Field of the Invention

This invention relates to a casting control system of a die cast machine, and more particularly to a casting control system wherein a high speed injection stroke of an injection plunger is automatically adjusted to provide optimum casting and the opening or closing of a breathing valve in a cavity is automatically adjusted to with a high speed injection real start position of the injection plunger.

2. Description of the Related Art

It is known that, as shown in FIG. 9, in the conventional die cast machine, an injection plunger 3 provided on a piston rod 2 of an injection cylinder 1 is advanced a full stroke S which comprises two stages including a low speed stroke SL and a high speed stroke Sh in an injection sleeve 5 connected to a mold assembly 4. Adjustment of the low speed injection stroke SL and the high speed injection stroke Sh is performed by adjusting the positional relationship between a dog 6 fixed onto a piston rod 2 and limit switches 7, 8.

In general, in a method of die casting, it is required that the injection plunger is moved at high speed by the high speed injection stroke Sh and a mold cavity is filled up with molten metal for a very short period of time, i.e. instantaneously, so that adjustment of this high speed injection stroke may greatly influence the quality of die cast products.

However, in the conventional example where the positional relationship between the dog 6 and the limit switches 7, 8 is adjusted to control the high speed injection stroke, the adjustment entirely relies on mechanical positioning, so that variable conditions of molding cannot be coped with and adjustment with high accuracy is difficult to perform, thereby lowering quality of the die cast products.

For this reason, as the result of studies and analyses, the necessity for directly and constantly controlling the high speed injection stroke in the real casting has been made clear, and the necessity for developing a system to realize this has been recognized.

Now, it is known that in die casting, gas in the mold cavity is degassed before filling the cavity with molten metal, and adjustment of timing of opening or closing of a breathing valve used for this is performed by adjusting the positional relationship between the dog and the limit switches 7, 8 and so forth.

However, the time required for the high speed injection stroke of the injection plunger is very short as aforesaid, and since this time is not much greater than an action delay time (including a relay action time) of a solenoid valve for actuating the breathing valve, the adjustment of the positional relationship between the dog 6 and the limit switches 7, 8 has been very difficult to carry out although it is very important. In consequence, when closing of the breathing valve is delayed, a possibility of blowing the molten metal out of the mold is very high, and the die cast products are lowered in quality due to a shift in timing of opening or closing of the valve.

SUMMARY OF THE INVENTION

It is an object of the present invention to provide a casting control system of a die cast machine, wherein the high speed injection stroke as being one of the factors of stabilizing the quality of the die cast products can be controlled constantly.

For this reason, the casting control system of a die cast machine according to the present invention features a position detecting means for detecting a stroke position of an injection plunger; arithmetic processing means for determining a speed increase inflexion point from a low speed injection to a high speed injection of said injection plunger, and a filling completion time point, and for calculating a high speed injection real stroke from said speed increase inflexion point and filling completion time point, said arithmetic processing means including memories for storing the results of said calculation; and data input means for inputting a preset value of an optimum high speed injection stroke which is inherent to a mold, and an action delay time of said injection plunger after actuation in response to a high speed injection start signal; whereby a plurality of real castings are carried out and a mean value of the high speed injection real strokes is determined by the arithmetic processing means, and the action delay time is corrected such that said mean value coincides with the preset value of the high speed injection real strokes.

According to the above-described arrangement of the present invention, the speed increase inflexion point of the injection plunger and the filling completion time point can be measured from the detection signal of the position detector, so that the high speed injection real stroke can be calculated in the arithmetic unit. Real castings are carried out a plurality of times in succession to sample the high speed injection real strokes, which samples are successively stored in the memory. When the high speed injection real strokes thus stored in the memory reach a predetermined sampling number, the high speed injection real strokes are read out to, obtain a mean value thereof. This mean value is compared with the aforesaid preset value in the arithmetic unit, and, on the basis of the result of this comparison, the aforesaid action delay time is corrected such that the mean value and the preset value coincide with each other.

It is another object of the present invention to provide a casting control system of a die cast machine, wherein a breathing valve is actuated at an optimum timing to eliminate a possibility of blow-out of molten metal, and cast products can be molded with consistent quality.

To this end, the casting control system of a die cast machine according to the present invention features that the casting control system comprises: position detecting means for detecting a stroke position of an injection plunger; arithmetic processing means for measuring a speed increase inflexion point of said injection plunger from a detection signal output from said position detecting means, the speed increase inflexion point thus measured being processed in a predetermined manner to obtain a high speed injection real start position, and a signal to close a breathing valve is output at a stroke position coinciding to said high speed injection real start position plus or minus a predetermined variable value, and a signal to open the breathing valve is output at a stroke position where said injection plunger closes a molten metal feeding port; and input means for inputting predetermined data into said arithmetic unit.

With the arrangement of this type, the speed increase inflexion point of the injection plunger is measured from the detection signal from the position detector. The values thus measured are calculated in the arithmetic unit so as to obtain a mean value of the measured values in the respective cycles, which are obtained under a predetermined process such as carrying out a plurality of trial castings, for example This mean value is determined to be the high speed injection real start position. The arithmetic unit outputs a signal to open the breathing valve at a position to which is added or from which is subtracted a variable value calculated on the basis of a delay time till the actuation of the breathing value and of a dispersion of the molten metal amounts with respect to the high speed injection real start position. The arithmetic unit then outputs a signal to open the breathing valve at a position where the injection plunger closes the molten metal feeding port. The inputter is used when a stroke value in association with a aforesaid delay time is set initially.

It is preferable that a sensor for sensing closing of the breathing valve is provided and this sensor is used for sensing closing of the breathing valve and measuring a closing stroke position of the valve so as to control the breathing valve such that the closing stroke position coincides with the preset closing stroke position.

With this arrangement, closing of the breathing valve is sensed by the breathing valve sensor and the measured value of the closing stroke position of the valve is compared with a preset stroke position and the valve is automatically controlled such that the both values coincide with each other, so that adjustment of timing of closing the valve can be performed with further higher accuracy.

DETAILED DESCRIPTION OF THE PREFERRED EMBODIMENT

Figure 1:
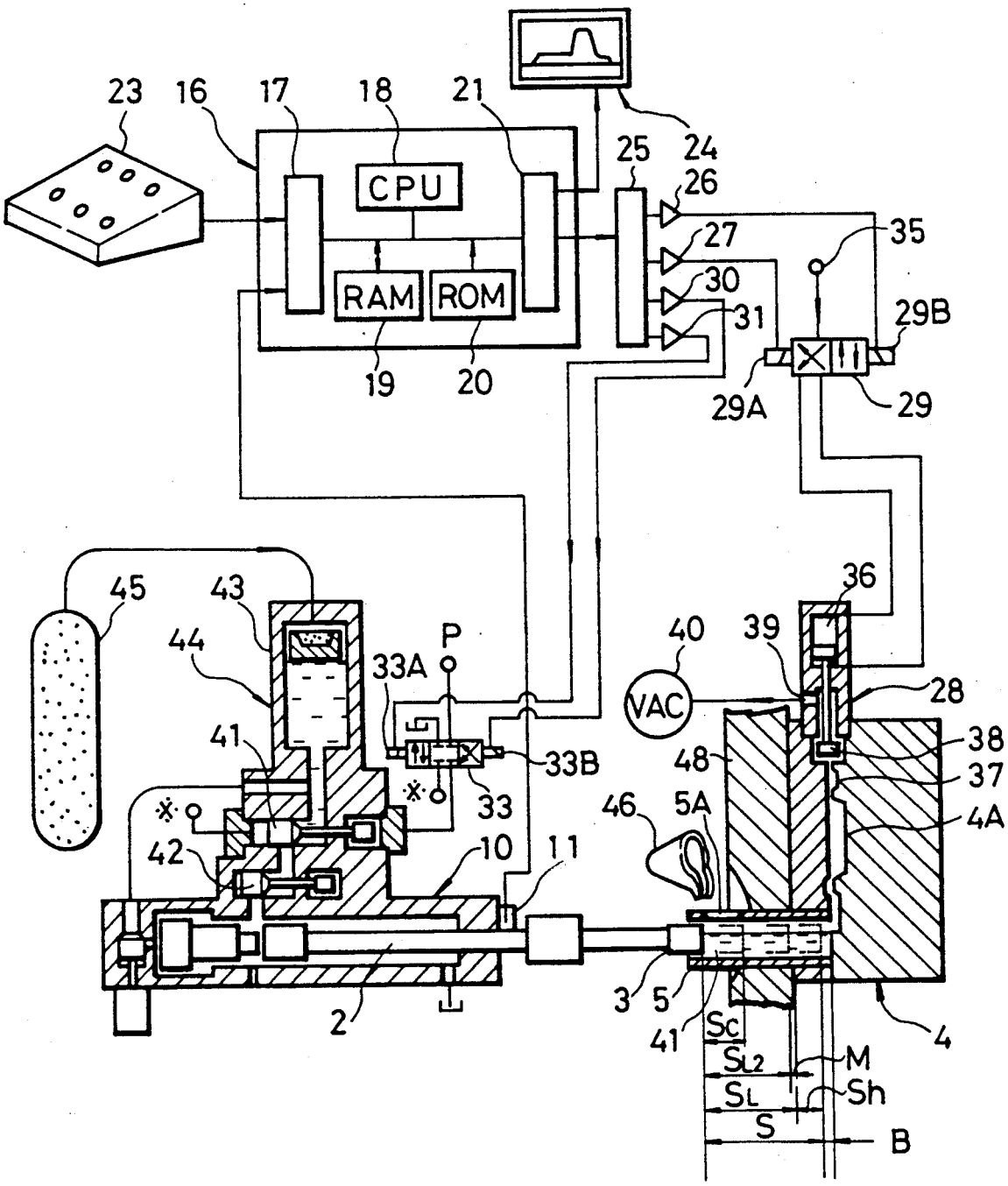
FIG. 1 is a general arrangement view showing the outline of a first embodiment of the present invention.

Embodiments of the present invention will hereunder be described with reference to the accompanying drawings. In the description of the embodiments which will be shown below, the component parts in the first embodiment are designated by the same, reference numerals as corresponding component parts of other embodiments to avoid duplicity and to simplify the description.

Figure 2:
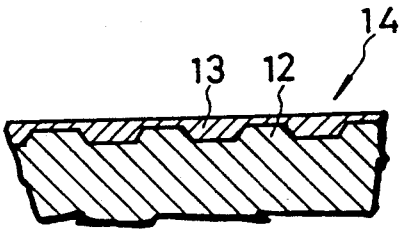
FIG. 2 is a sectional view showing a portion of a magnetic scale constituting the position detector.

FIG. 1 shows the general arrangement of the casting control system of a die cast machine according to the first embodiment. Referring to the drawing, a position detector 11 is provided on one side of a piston rod 2 of a die cast machine 10 for detecting a position of the piston rod 2 and injection plunger 3 in an injection sleeve 5. This position detector 11 is formed of a magnetic sensor using a magnetic resistor element and, as shown in FIG. 2, has such an arrangement that magnetic ridges 12 and non-magnetic grooves 13 are alternately arranged at a predetermined pitch in fringe shapes and a magnetic scale 14, which is nickel or chromium plated, is included therein. The position detector 11 is connected to an arithmetic unit 16, and a detection signal from the position detector 11 is input to the arithmetic unit 16.

The arithmetic unit 16 includes: an inputter 17 into which a position detection signal is input; a CPU 18 for calculating (in a predetermined process) data from the position detection signal input to the inputter 17 memories 19 and 20 for storing the results of calculations completed by this CPU 18, and an outputter 21 for outputting a predetermined signal in response to the result of the CPU calculations.

A data inputter 23 is connected to the inputter 17 of the arithmetic unit 16 for inputting the following data: a stroke Sc at which the injection plunger 3 closes a molten metal feeding port 5A; a stroke SL (low speed injection stroke) of a high speed injection start position; a variable value M obtained by the calculation based on an action delay time till valve closing of a breathing valve device 28 to be described hereunder and on a biscuit thickness B due to a dispersion of molten metal amounts; a preset value Sh of a high speed injection stroke of the injection plunger 3; and an action delay time Δt of a solenoid valve device 33 to be described hereunder for controlling the injection plunger 3. The preset value Sh is set in accordance with conditions inherent to a mold and the like, and input as 150.5 mm for example on a unit of 0.5 mm. When an action delay time till valve closing of the breathing valve device is set at Δts, the dispersion of the biscuit thickness B is set at ΔB and an allowance value is set at C, the variable value M is represented by the following equation.

$$M=\Delta B+(V_L\times\Delta ts)+C$$

where VL is a low injection speed, and a program of calculations according to the above equation is previously input into the arithmetic unit 16.

Further, connected to the arithmetic unit 16 is a display unit 24 such as a CRT. In this display unit 24, a moving stroke and injection speed of the injection plunger 3 are displayed, respectively. The arithmetic unit 16 delivers excitation signals to respective solenoids 29A and 29B of a solenoid valve 29 for actuating the breathing valve device 28 via an interface 25, amplifiers 26 and 27, and delivers excitation signals to respective solenoids 33A and 33B of a solenoid valve 33 for switching from a low speed injection to a high speed injection of the injection plunger 3 via amplifiers 30 and 31.

The breathing valve device 28 is formed of a vacuum valve device and includes: a hydraulic cylinder 36 connected to a hydraulic source 35 via the solenoid valve 29; a valve 38 facing to a breathing groove 37 which connects with a cavity 4A of the mold assembly 4; and a gas discharge port 39, to which is connected a vacuum device 40.

When a pulse signal emitted from the position detector 11 associated with the stroke Sc is counted in the arithmetic unit 16 and output by the outputter 21 in a real injection, the breathing valve device 28 excites the solenoid 29A of the solenoid valve 29 via the interface 25 and the amplifier 27, whereby the valve 38 of the breathing valve device 28 is opened by means of the hydraulic cylinder 36, so that gas in the cavity 4A is discharged into the vacuum device 40 through the discharge port 39.

On the other hand, when a signal is output from the outputter 21 and $SL_2$ spaced M apart from $SL_1$, which is a high speed injection real stroke position, to excite the solenoid 29B of the solenoid valve 29 via the interface 25 and the amplifier 26, the hydraulic cylinder 36 is actuated to close the valve 38 of the breathing valve device 28.

The solenoid valve 33 for switching from the low speed injection to the high speed injection of the injection plunger 3 is connected to a low speed injection-high speed injection switching valve 41 which constitutes a hydraulic control valve device 44 in cooperation with an ON-OFF switch 42 and a piston accumulator 43 to which is connected a gas accumulator 45.

In FIG. 1, is a ladle designated at 46 which is to be filled up with the molten metal, and a stationary die plate 48 is also shown.

Figure 3:
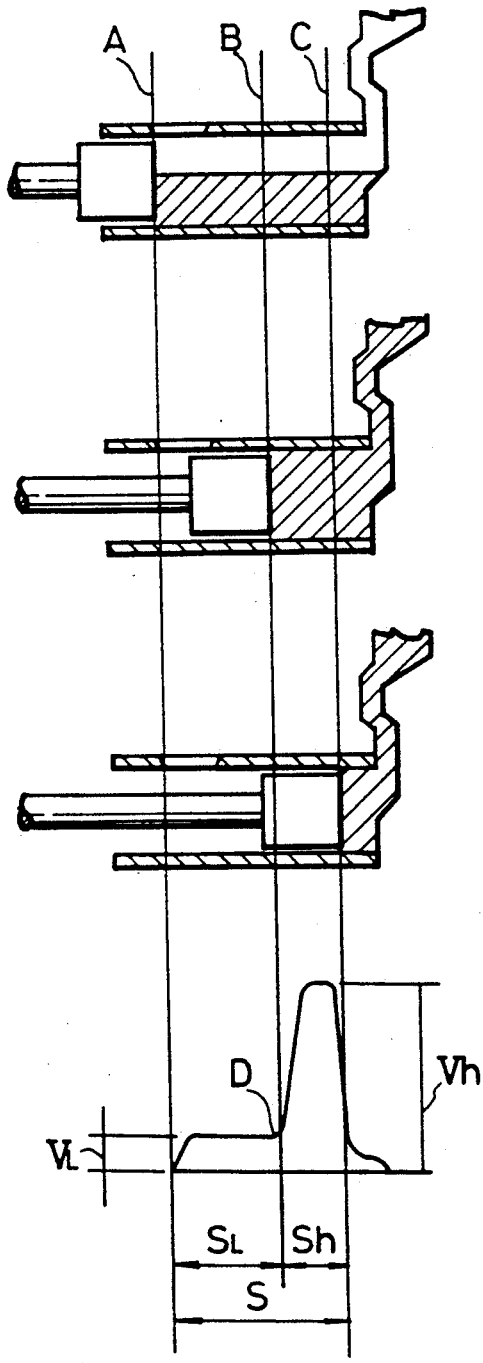
FIG. 3 is a view showing the relationship between the injection stroke and the injection speed.

The relationship between the injection stroke and the injection speed of the injection plunger and the speed increase inflexion point D of the injection speed will hereunder be described with reference to FIGS. 3 and 4. In FIG. 3, a full injection stroke S is divided into two distinct lengths including the low speed injection stroke SL and a high speed injection stroke Sh. The injection plunger 3 is driven at a speed VL during the low speed injection stroke SL, while the plunger is driven at a speed Vh during the high speed injection stroke Sh. In this case, the injection strokes and the injection speeds are determined by the die cast products, conditions of the mold assembly or the like. Incidentally, in the drawing, denoted at A is a low speed injection start position of the injection plunger 3 in the injection sleeve 5. B is high speed injection start position, and C is a filling completion position.

Figure 4:
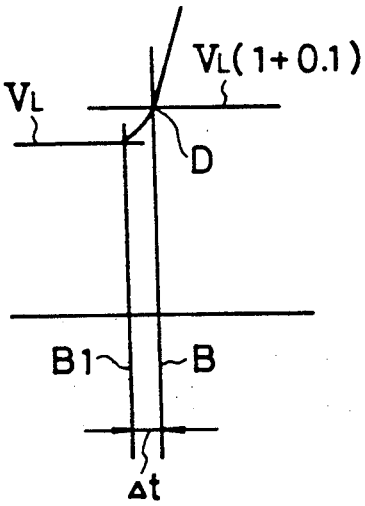
FIG. 4 is a chart enlargedly showing an oscillograph of the portion of the speed increase inflexion point D.

As shown in the enlarged oscillograph of FIG. 4, the speed increase inflexion point D of the injection speed is defined as a point at which the speed is increased by 10% or more with respect to the low injection speed VL, i.e. a point of VL (1+0.1). The program of calculations is stored in the memory 19 of the arithmetic unit 16. In the CPU 18, the high speed injection start position B corresponding to the injection speed increase inflexion point D of the above-described condition is calculated, and at a point $B_1$ (which is the anticipated action delay time Δt of the solenoid valve device 33 which controlls the low speed injection-high speed injection switching valve 41) a high speed injection start signal is output, and the solenoid 33A is actuated by this signal output.

Figure 5:
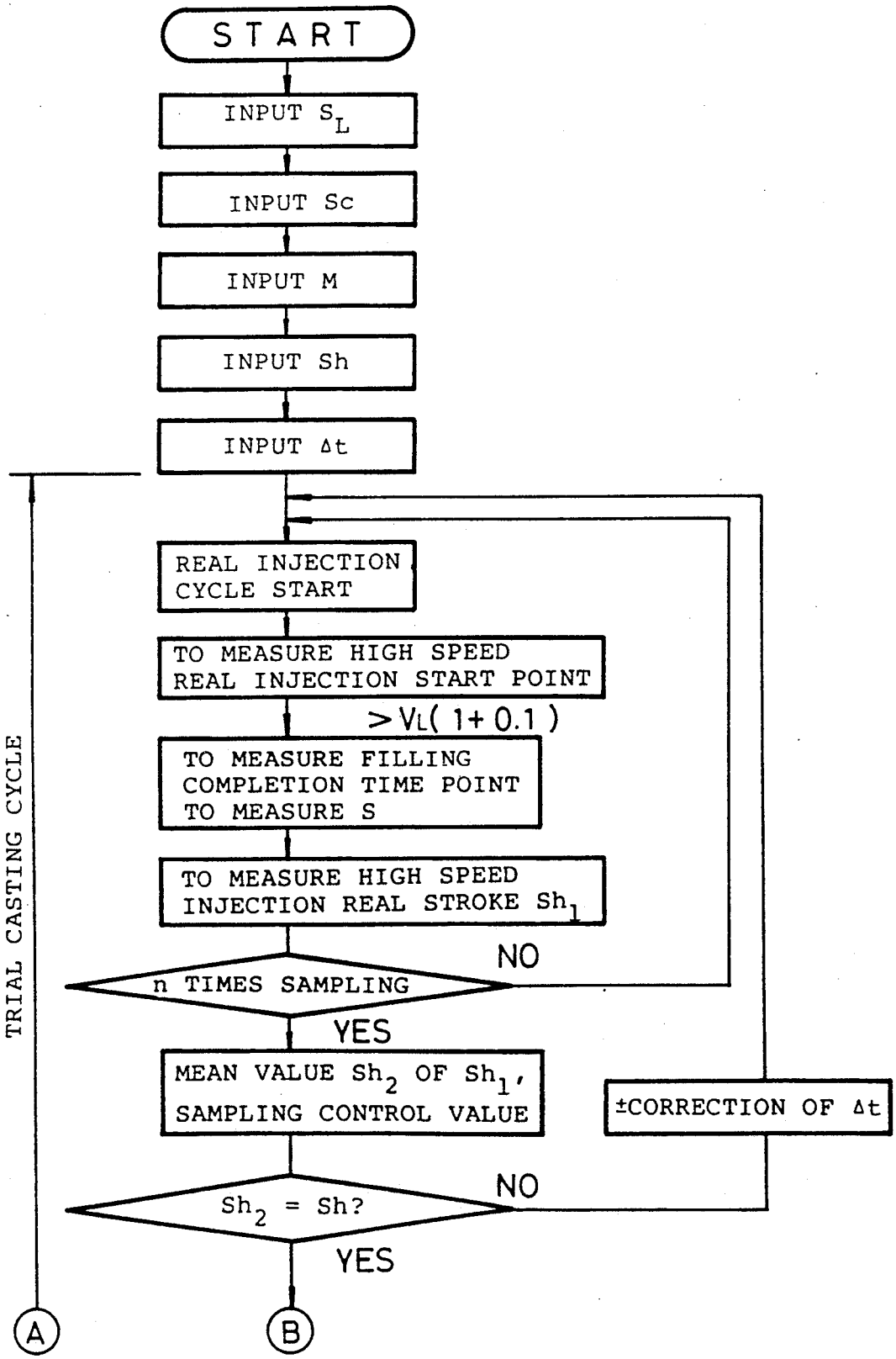
FIG. 5(A) and (B) is a flow chart of the above embodiment.
Figure 5:
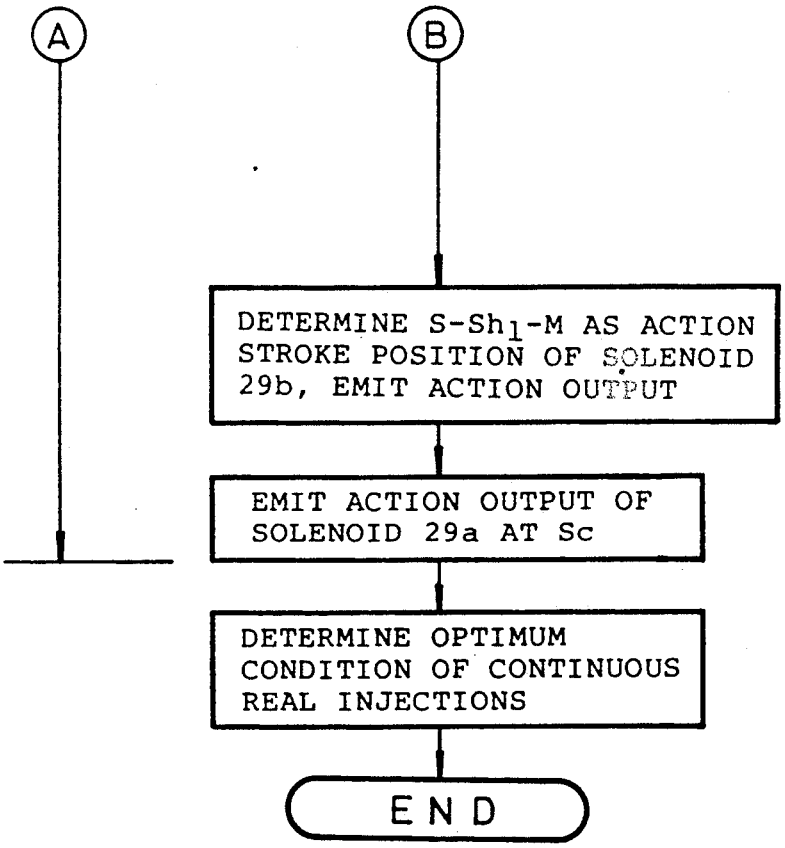

Operation of this embodiment will hereunder be described with reference to FIG. 5(A) and (B).

Prior to the start of trial casting cycles, the data inputter 23 inputs the stroke SL (low speed injection stroke) at the high injection start position, the stroke Sc at which the injection plunger 3 closes the molten metal feeding port 5A, the variable value M determined from the delay time till the closing of the valve 38 in the breathing valve device 28 and the dispersion of the molten metal amounts, the high speed injection stroke Sh as being the preset value in association with the conditions of molding which are inherent to the mold assembly and the action delay time Δt of the solenoid valve 33, respectively, and these inputs are stored in the arithmetic unit 16.

After this initial setting work is completed trial casting cycles are performed whereby a number of real injections are carried out. The speed increase inflexion point D and the filling completion time point are measured from a position detection signal of injection plunger 3, which is delivered by the position detector 11. In this case, the speed increase inflexion point D is defined speed injection real start position, and, a stroke to this high speed injection real start position is stored in the memory 19 as SL. Simultaneously, a difference between the high speed injection real start position and the filling completion time point is searched as a high speed injection real stroke $Sh_1$, which is stored in the memory 19.

The real injections are continuously performed a plurality of times. When the high speed injection real strokes Sh1 obtained in every injection cycle reach a predetermined number of samplings the CPU 18 reads out the high speed injection real strokes $Sh_1$, which have been successively stored in the memory 19, and calculates out a mean value $Sh_2$ thereof. This mean value Sh2 is compared with the preset value Sh of the high speed injection stroke which has been previously input. When the mean value $Sh_2$ and the preset value Sh do not coincide with each other, ± correction of the action delay time Δt of the solenoid valve 33 is carried out step by step in the arithmetic unit 16, and the trial casting cycles are continuously carried out until the mean value $Sh_2$ and the preset value Sh coincide with each other. Incidentally, the unit of ± correction of Δt is 10 ms for example.

After the mean value $Sh_2$ and the preset value Sh coincide with each other, a timing adjustment is made such that the solenoid 29B of the solenoid valve 29 is at $S\text{-}SH_1\text{-}M$, at the speed increase inflexion point D a signal to close the valve 38 of the breathing valve device 28 is output and the valve 38 is thereby closed at the high speed injection real start position $S\text{-}Sh_1$.

As a consequence, according to the first embodiment as described above, the optimum value of the high speed injection stroke is maintained and the manual adjusting work of the past is eliminated. The action delay time Δt of the solenoid is adjusted to compensate for the difference between the high speed injection real stroke obtained on the basis of the real casting and the preset value, so that the high speed injection stroke which greatly influences the quality of die cast products can be adjusted with high accuracy, thereby providing the products having a constant quality.

The aforesaid adjustment can be automatically calculated according to the predetermined program in the arithmetic unit 16, thereby offering the advantages that the adjusting work to be performed by an operator can be eliminated and adjustment can be performed for a short period of time.

The solenoid 29B is excited at a stroke position determined by adding or subtracting the predetermined value M (i.e. the variable value M is obtained on the basis of the action delay time till the closing of the valve 38 of the breathing valve device 28 and the biscuit thickness B due to the dispersion of the molten metal amounts) to the high speed injection real start position. Therefore, the timing adjustment for closing the valve 38 of the breathing valve device 28 is performed at the high speed injection real start position, thereby offering the advantages that control of opening or closing of the valve can be carried out with high accuracy in accordance with the conditions of the real castings, and particularly, blow-out of the molten metal due to a shift in the timing of closing can be avoided.

The timing adjustment can be controlled automatically by the arithmetic unit 16, so that the adjusting work can be performed for a very short period of time.

Figure 6:
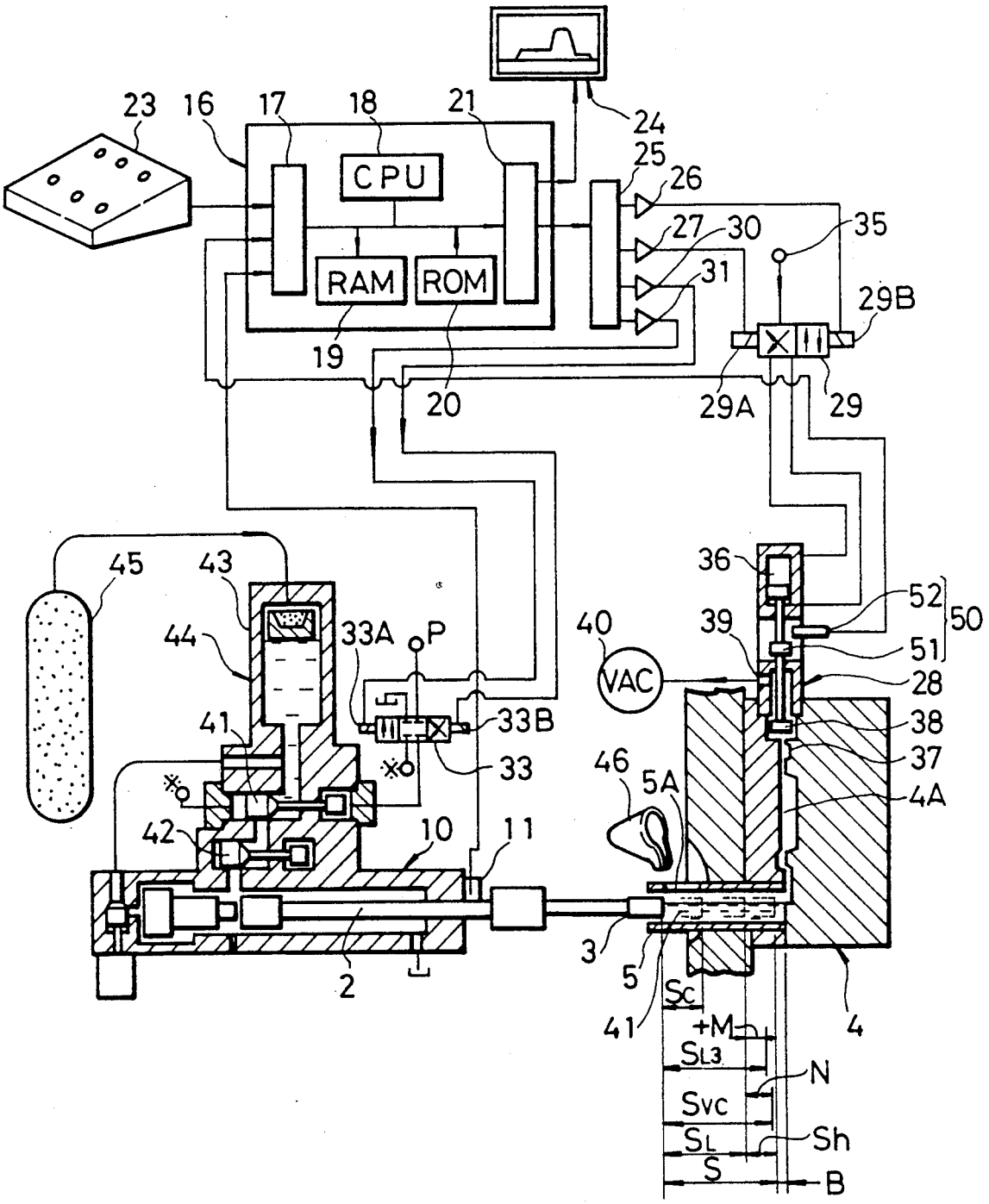
FIG. 6 is a general arrangement view showing the outline of a second embodiment.
Figure 7:
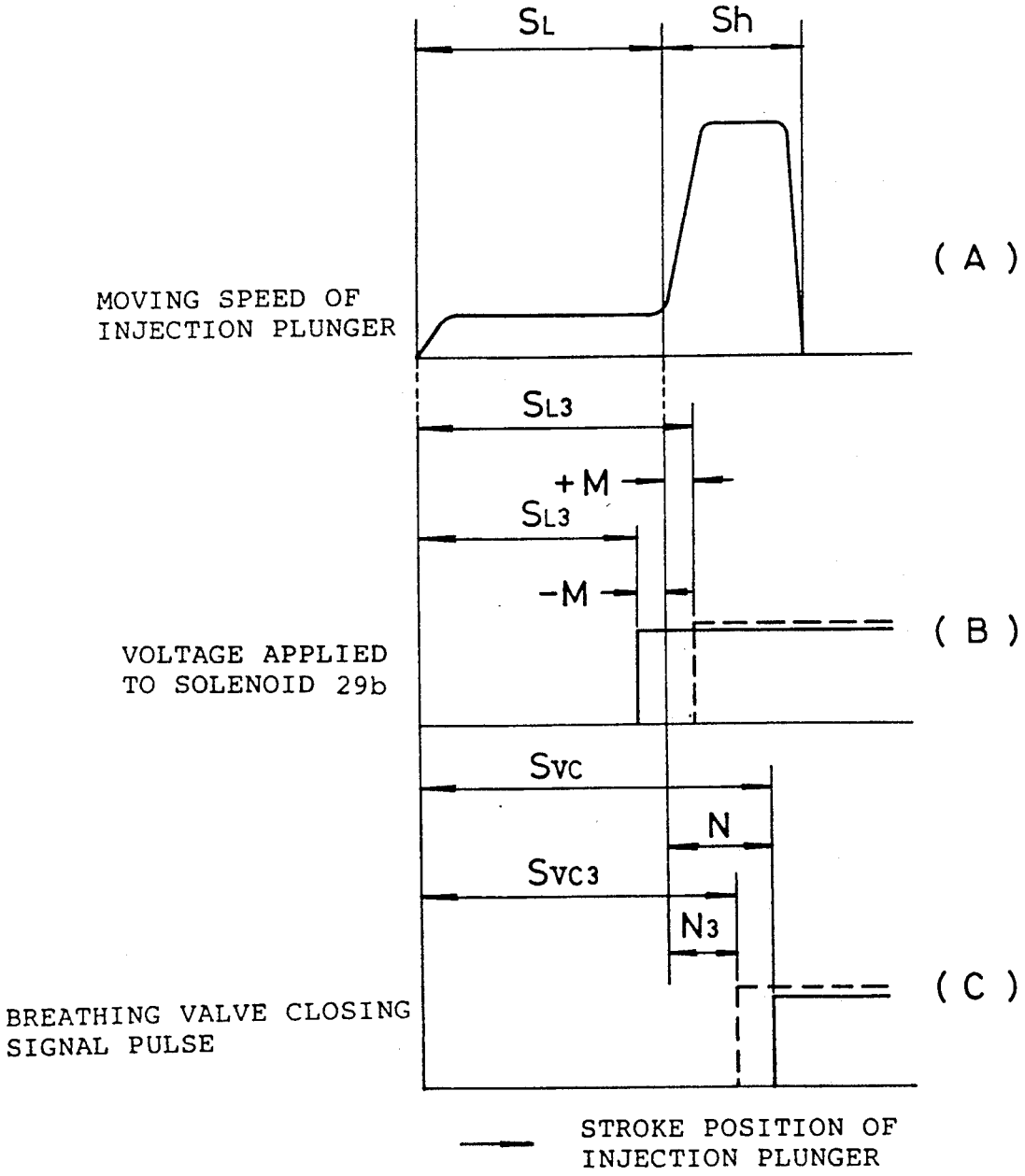
FIG. 7 is a chart showing the moving speed of the injection plunger, the voltage applied to the solenoid and the closing signal pulses.
Figure 8:
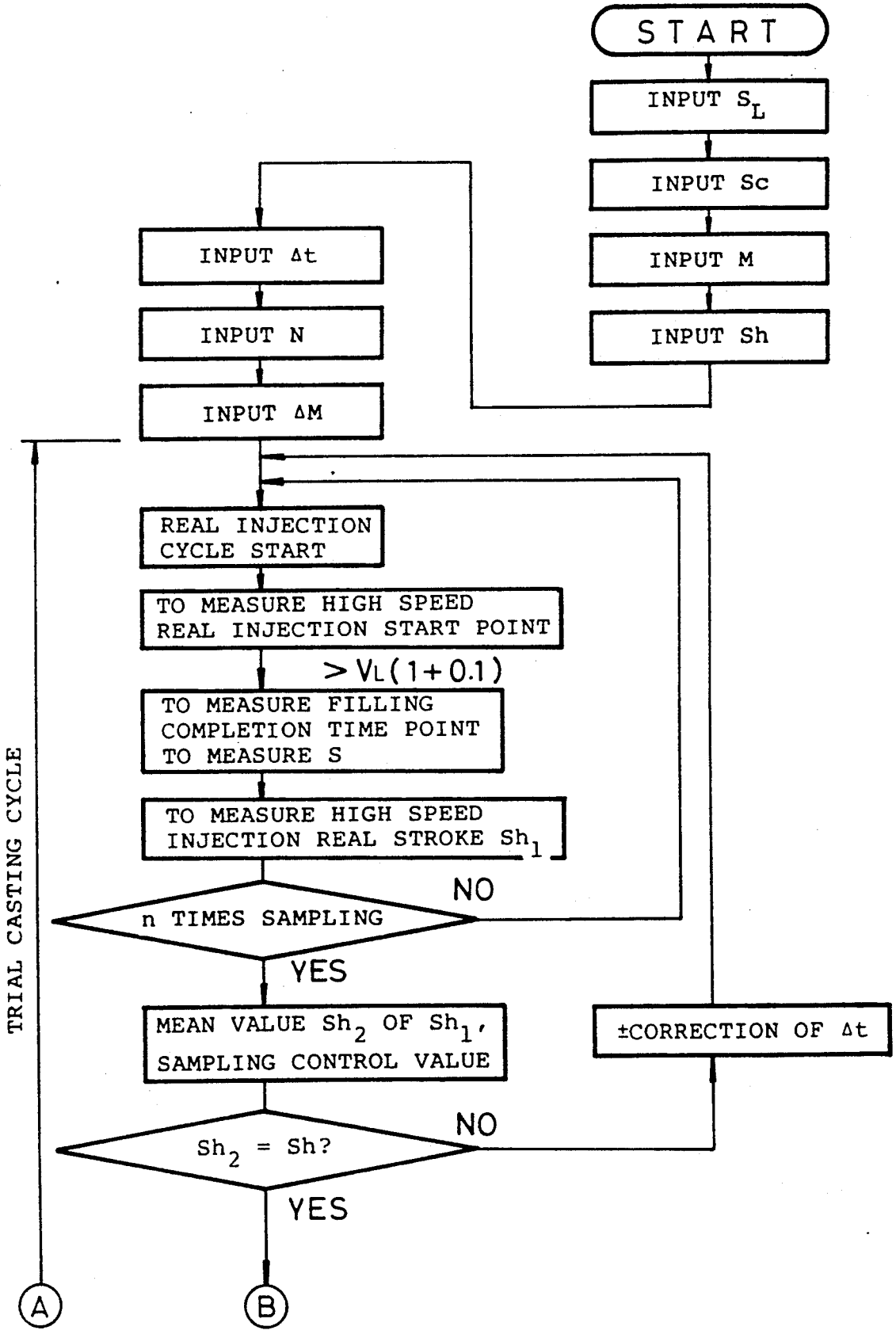
FIG. 8(A) and (B) is a flow chart of the second embodiment.
Figure 8:
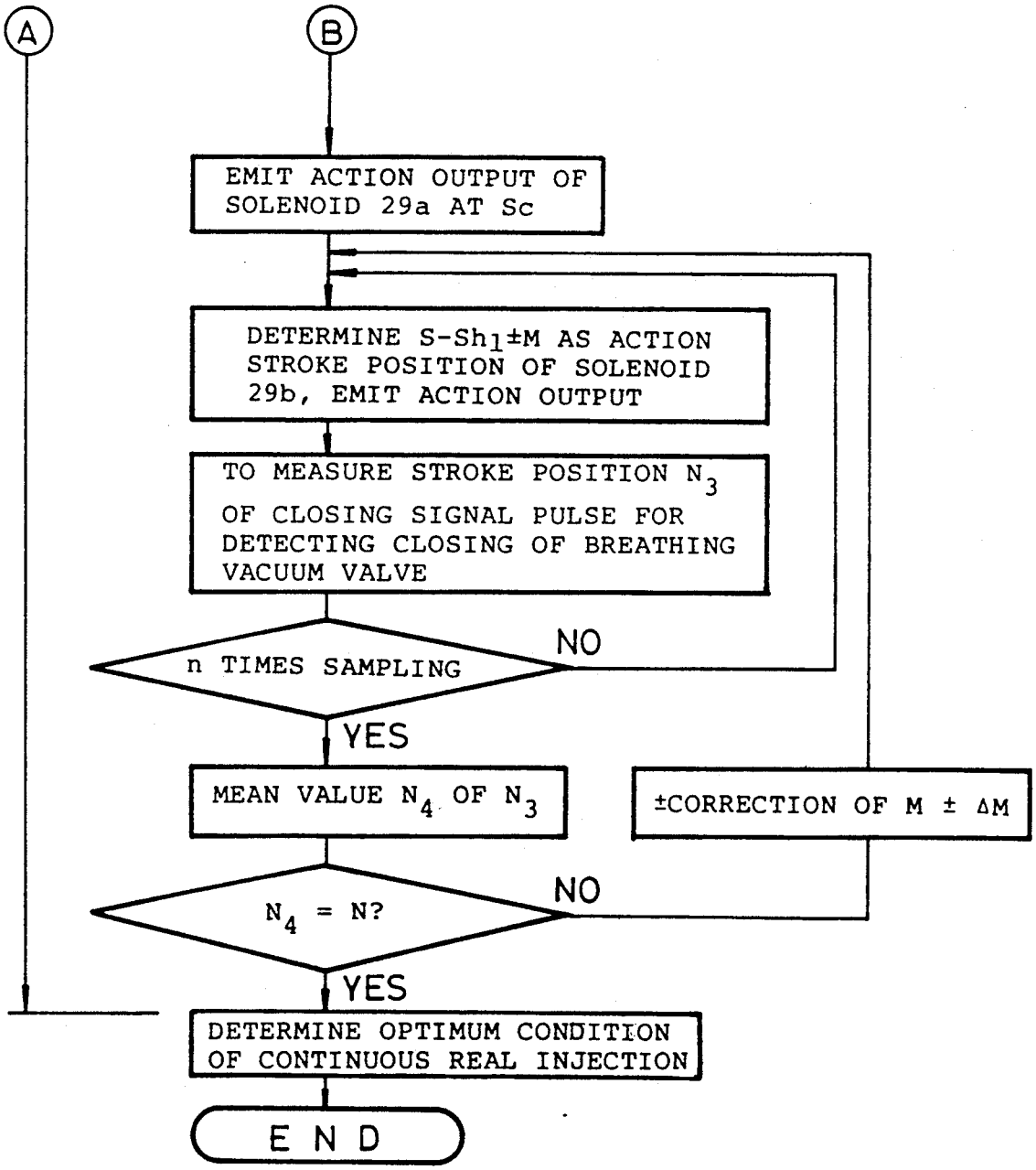
Figure 9:
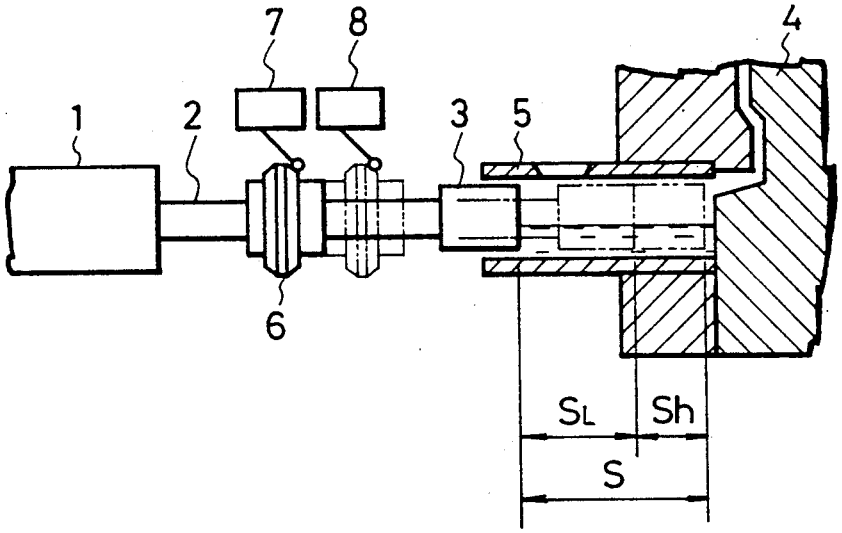
FIG. 9 is a schematic block diagram showing the conventional injection device.

The second embodiment of the present invention will hereunder be described with reference through FIGS. 6 to 8. Incidentally, the component parts in the second embodiment corresponding to those of the first embodiment are designated by the same reference numerals to avoid duplicity and to simplify the description.

This second embodiment features a sensor 50 for sensing closing of the valve 38 in the breathing valve device 28. Closing stroke positions of the valve 38 are measured at every trial casting cycle, and control is carried out such that the mean value of the measured values coincides with the preset value.

The sensor 50 includes: a magnetic material 51 fixed on the piston rod of breathing valve device 28; and a detector 52 provided at a position corresponding to a closed position of the piston rod and the magnetic material 51 fixing (not shown). The detecting section 52 delivers closing signal pulses to the inputter 17 of the arithmetic unit 16 in a state where the valve 38 is entirely closed.

In the above-described arrangement, as shown in FIG. 7(B), the variable value M (which is determined on the basis of the action delay time until the closing of the valve 38 in the breathing valve device 28 and the dispersion of the molten metal amounts) is set at the plus side and the minus side, respectively, with respect to the high speed injection start position Sh. When a voltage is applied to the solenoid 29B of the solenoid valve device 29 at a stroke position at which the low speed injection stroke is $SL \pm M = SL3$, the valve 38 begins to close. Further, the sensors 50 sense when the valve 38 is entirely closed, and, as shown in FIG. 7C, produces closing signal pulses, which are output into the inputter 17 of the arithmetic unit 16. In this case, a stroke position where the closing signal pulses are produced is set at Svc and the optimum closing position of the valve 38 is set at *Svc−SL=N, and these values are input into the arithmetic unit 16 via the inputter 23.*

In FIG. 7(C), reference character Svc3 indicates the measured value of the stroke position from the initial point of the injection plunger 3 and $N_3$ indicates the measured value of the closing signal stroke position of the valve 38.

Operation of the second embodiment will hereunder be described with reference to FIG. 8.

In the initial setting work, inputs from the inputter 23 are performed substantially in the same manner as in the first embodiment. However, in this second embodiment, the aforesaid set value N, and ΔM (which is the ± correction value of the preset value M) are additionally input. In this case, the minimum unit of ΔM is set at 0.5 mm for example.

After the above-described initial setting work is completed, a number of trial casting cycles are performed to carry out real injections, and, in the same manner as in the first embodiment, Δt is ± corrected until the mean value $Sh_2$ of the high speed injection real strokes $Sh_1$ and the preset value Sh coincide with each other.

After the mean value $Sh_2$ and the preset value Sh coincide with each other, an actuation signal to the solenoid 29A is output at the stroke position Sc of the injection plunger 3. Subsequently, an actuation signal to the solenoid 29B is output at a stroke position of $S\text{-}SH_1 \pm M$, and the stroke at which the sensor 50 senses the closing of the valve 38 and outputs the closing signal pulses is a measured to be value $N_3$. The above-described cycles are continuously carried out a plurality of times, and when a predetermined number of samples has been obtained, a mean value $N_4$ of these N3 values is calculated. A comparison is then made to determine whether this mean value $N_4$ coincides with the aforesaid preset value N or not, and a ± correction is made to the variable value M by ΔM until the mean value N4 coincide with the set value N. The entire process is completed on condition that the both values coincide with each other.

In consequence, according to the second embodiment as described above, in addition to the advantages of the first embodiment, in performing the adjustment of valve opening or closing of the breathing valve device 28, the stroke of the closing signal pulses of the valve 38 is measured, the mean value N4 obtained by sampling control is compared with the set value N, and an incremental ± correction is made to the set value M by ΔM as necessary, so that the action delay time of the solenoid valve 29 for actuating the breathing valve device 28 can be flexibly and accurately grasped in accordance with the conditions of casting and the like, thereby adding the advantage that the control of opening or closing the valve 33 can be carried out with high accuracy.

As a means of performing the timing adjustment, one arithmetic unit is used, so that there is no possibility of rendering the system as a whole large-sized.

In the above embodiments, examples in which the present invention is applied to a cold chamber die cast machine are shown and description is made with reference to these examples, however, the present invention can also be applied to a hot chamber die cast machine.

The arrangement of the position detector 11 need not necessarily be limited to the one shown in the above embodiments, and other detectors such as an optical linear encoder capable of detecting the stroke position of the injection plunger 3 are applicable.

Further, in the above embodiments, the gas in the mold cavity 4A is degassed into the vacuum device 40, however, such an arrangement that the gas thus degassed may be simply discharged to the atmosphere may be adopted.

As has been described hereinabove, the present invention can provide the casting control system of a die cast machine, offering the advantages that the high speed injection stroke as being one of the factors for stabilizing the quality of the die cast products can be controlled constantly, the breathing valve is actuated at the optimum timing to eliminate a possibility of blow-out of the molten metal, and the cast products whose quality is held constant can be molded.

What is claimed is:

1. A casting control system of a die cast machine, comprising:

position detecting means for detecting a stroke position of an injection plunger;

arithmetic processing means for measuring a speed increase inflexion point of said injection plunger from a detection signal output from said position detecting means, the speed increase inflexion point thus measured being processed in a predetermined manner to obtain a high speed injection real start position, and a signal to close a breathing valve is output at a stroke position coinciding with said high speed injection real start position plus or minus a predetermined variable value, and a signal to open the breathing valve is output at a stroke position where said injection plunger closes a molten metal feeding port; and input means for inputting predetermined data into said arithmetic unit.

2. A casting control system of a die cast machine as set forth in claim 1, further comprising sensing means for sensing closing of said breathing valve, whereby the closing of said valve is sensed to measure a closing stroke position of said valve, and control of said valve is carried out such that the measured closing stroke position and a preset closing stroke position of said valve coincide.

3. A casting control system of a die cast machine as set forth in claim 2, wherein a closing stroke position is measured every trial casting cycle, a mean value of said measured closing stroke positions is calculated, and control of said valve is carried out such that said mean value and the preset closing stroke position coincide.

4. A casting control system of a die cast machine as set forth in claim 8, wherein a predetermined value is added to or subtracted from a variable value when said mean value and the preset closing stroke position do not coincide with each other.

5. A casting control system of a die cast machine as set forth in claim 1, wherein said speed increase inflexion point is a point at which an injection plunger speed is increased by at least 10% with respect to a low injection speed.

6. A casting control system of a die cast machine, comprising:

position detecting means for detecting a stroke position of an injection plunger;

arithmetic processing means for measuring a speed increase inflexion point of said injection plunger and a filling completion time point from a detection signal output from a position detecting means, and said arithmetic processing means for processing the speed increase inflexion point and filling completion time point in a predetermined manner to calculate a high speed injection real start position and a high speed injection real stroke;

breathing valve means actuated in response to an output signal from said arithmetic processing means;

sensing means for sensing closing of a valve in said breathing valve means; and input means for inputting predetermined data into said arithmetic processing means;

wherein said arithmetic processing means stores a preset value of an optimum high speed injection inherent to a mold and an action delay time of said injection plunger signal, and a plurality of trial casting cycles are continuously carried out to measure a mean value of the high speed injection real strokes, and said arithmetic processing means compares the mean value with said preset value and incrementally and decrementally corrects said action delay time such that the mean value and present value coincide; and said arithmetic processing means outputs a signal to close the breathing valve at a stroke position coinciding with said high speed injection real start position plus or minus a predetermined variable value, the said arithmetic processing means outputs a signal to open said breathing valve at a stroke position where said injection plunger closes a molten metal, and said arithmetic processing means adds to or subtracts from said variable value such that the closing stroke position of said breathing valve, which is measured via said sensor, and the preset closing stroke position coincide.

7. A casting control system of a die cast machine, comprising:

position detecting means for detecting a stroke position of an injection plunger;

arithmetic processing means for measuring a speed increase inflexion point of said injection plunger from a detection signal output from said position detecting means, the speed increase inflexion point thus measured being processed in a predetermined manner to obtain a high speed injection real start position, and a signal to close a breathing valve is output at a stroke position coinciding with said high speed injection real start position plus or minus a predetermined variable value, and a signal to open the breathing valve is output at a stroke position where said injection plunger closes a molten metal feeding port; and input means for inputting predetermined data into said arithmetic unit; and sensing means for sensing closing of said breathing valve, whereby the closing of said valve is sensed to measure a closing stroke position of said valve, and control of said valve is carried out such that the measured closing stroke position and a preset closing stroke position of said valve coincide.

8. A casting control system of a die cast machine as set forth in claim 7, wherein a closing stroke position is measured every trial casting cycle, a mean value of said measured closing stroke positions is calculated, and control of said valve is carried out such that said mean value and the preset closing stroke position coincide.

9. A casting control system of a die cast machine as set forth in claim 8, wherein a predetermined value is added to or subtracted from a variable value when said mean value and the preset value do not coincide.

* * * * *